US011807441B2

(12) United States Patent
Lenart et al.

(10) Patent No.: US 11,807,441 B2
(45) Date of Patent: Nov. 7, 2023

(54) PACKAGING PRODUCT AND METHODS OF MAKING AND USING

(71) Applicant: Ranpak Corp., Concord Township, OH (US)

(72) Inventors: Craig L. Lenart, Chardon, OH (US); Shawn M. Baiers, North Olmsted, OH (US); Robert C. Cheich, Independence, OH (US); Dennis J. Wagner, Painesville, OH (US)

(73) Assignee: Ranpak Corp., Concord Township, OH (US)

( * ) Notice: Subject to any disclaimer, the term of this patent is extended or adjusted under 35 U.S.C. 154(b) by 84 days.

(21) Appl. No.: 17/048,653

(22) PCT Filed: Jul. 11, 2018

(86) PCT No.: PCT/US2018/041549

§ 371 (c)(1),
(2) Date: Oct. 19, 2020

(87) PCT Pub. No.: WO2019/209359

PCT Pub. Date: Oct. 31, 2019

(65) Prior Publication Data

US 2021/0237961 A1 Aug. 5, 2021

Related U.S. Application Data

(60) Provisional application No. 62/661,402, filed on Apr. 23, 2018.

(51) Int. Cl.
*B65D 81/38* (2006.01)
*B31D 5/00* (2017.01)
(Continued)

(52) U.S. Cl.
CPC ..... *B65D 81/3823* (2013.01); *B31D 5/0047* (2013.01); *B65B 13/02* (2013.01);
(Continued)

(58) Field of Classification Search
CPC .. B31D 5/0043; B31D 5/0047; B31D 5/0004; B31D 2205/0064; B31D 5/0039;
(Continued)

(56) References Cited

U.S. PATENT DOCUMENTS 5,044,493 A * 9/1991 Crawford ..... A61B 42/40 206/83.5
5,180,060 A 1/1993 Forti et al.
(Continued)

FOREIGN PATENT DOCUMENTS

CN 110382369 A 10/2019
EP 2203304 B1 5/2015
(Continued)

OTHER PUBLICATIONS

First Examination Report dated May 17, 2021, for related Indian Patent Application No. 202017047726.
(Continued)

*Primary Examiner* — Rafael A Ortiz
(74) *Attorney, Agent, or Firm* — Renner, Otto, Boisselle & Sklar, LLP

(57) ABSTRACT

A bundle of packing material includes at least two strips of packing material folded into a compact configuration. The strips of packing material include a top strip having a length dimension between first and second end portions and a central portion between the first end portion and the second end portion, and a bottom strip having a length dimension between first and second end portions and a central portion between the first end portion and the second end portion. The central portion of the top strip overlays the central portion of
(Continued)

the bottom strip and the length dimension of the top strip is oriented orthogonal to the length dimension of the bottom strip. The first and second end portions of top strip are folded over the central portions, and the first and second end portions of the bottom strip are folded over the central portions.

15 Claims, 12 Drawing Sheets

(51) Int. Cl.
*B65B 13/02* (2006.01)
*B65D 5/50* (2006.01)
*B65D 71/02* (2006.01)

(52) U.S. Cl.
CPC ..... *B65D 5/5028* (2013.01); *B65D 71/02* (2013.01); *B31D 2205/0064* (2013.01)

(58) Field of Classification Search
CPC .. B65D 71/02; B65D 81/3823; B65D 5/5028; B65B 13/02
USPC ..... 206/494, 400, 389, 83.5
See application file for complete search history.

(56) References Cited

U.S. PATENT DOCUMENTS

| | | | | |
|---|---|---|---|---|
| 5,643,167 | A | 7/1997 | Simmons | |
| 7,044,277 | B2 * | 5/2006 | Redzisz | A45C 7/0095 190/107 |
| 2008/0210591 | A1 | 9/2008 | Cheich | |
| 2011/0127272 | A1 | 6/2011 | Crespo et al. | |
| 2015/0114875 | A1 | 4/2015 | McDonald | |
| 2015/0305537 | A1 * | 10/2015 | Zich | A47G 27/0212 428/319.1 |
| 2016/0023831 | A1 * | 1/2016 | Cheich | B65D 81/051 493/383 |

FOREIGN PATENT DOCUMENTS

| | | | | |
|---|---|---|---|---|
| JP | H06501669 | A | 2/1994 | |
| JP | H06156540 | A | 6/1994 | |
| JP | 3008532 | U | 3/1995 | |
| JP | H07187242 | A | 7/1995 | |
| JP | H10305801 | A | 11/1998 | |
| JP | 2000313482 | A | 11/2000 | |
| JP | 2001501896 | A | 2/2001 | |
| JP | 2003276767 | A2 | 10/2003 | |
| JP | 2005178834 | A | 7/2005 | |
| JP | 2016517375 | A | 6/2016 | |
| KR | 960029207 | A | 8/1996 | |
| WO | 1998012496 | A1 | 3/1998 | |
| WO | 01/89936 | A2 | 11/2001 | |
| WO | WO-0189936 | A2 * | 11/2001 | B65D 81/127 |
| WO | 2006/081360 | A2 | 8/2006 | |
| WO | 2014144428 | A2 | 9/2014 | |

OTHER PUBLICATIONS

Communication pursuant to Rule 164(2)(b) and Article 94(3) dated Nov. 30, 2021, for corresponding European Regional Phase Patent Application No. 18746813.7.
Notice of Reason for Rejection dated Apr. 13, 2022, for corresponding Korean Patent Application No. 10-2020-7031991.
International Search Report and Written Opinion dated Feb. 2, 2019 for International Patent Application No. PCT/US2018/041549.
Office Action published Sep. 20, 2022, for co-pending Brazilian Patent Application No. BR1120200215031.

* cited by examiner

PACKAGING PRODUCT AND METHODS OF MAKING AND USING

RELATED APPLICATIONS

This application is a national phase of International Application No. PCT/US2018/041549, filed Jul. 11, 2018 and published in the English language, and which claims priority to U.S. Application No. 62/661,402 filed Apr. 23, 2018, both of which are hereby incorporated herein by reference in their entireties.

FIELD OF THE INVENTION

The present invention is related to a packaging product, and more particularly to dunnage product for lining a shipping container, a corresponding method of making the packaging product, and a method of using the packaging product.

BACKGROUND

Dunnage conversion machines convert a stock material into a dunnage product that can be used to pack articles in a shipping container and thus minimize or prevent damage during shipment. Dunnage conversion machines, also referred to as dunnage converters, generally include a conversion assembly that converts a stock material into a relatively lower density dunnage product as the stock material moves through the conversion assembly from an inlet at an upstream end toward an outlet at a downstream end.

Exemplary dunnage conversion machines already in use convert a sheet stock material, such as kraft paper, into a dunnage product that can then be placed into a container to protect articles being shipped. Such dunnage conversion machines typically convert a substantially continuous length of sheet stock material into a strip of dunnage, from which discrete lengths of dunnage product are severed for placement in a container by a packer in a desired configuration.

SUMMARY

The present invention provides a method for the production of a bundle of dunnage products that can be produced on demand, and a method for using the bundled dunnage products in packing an article for shipment in a container protected by the dunnage products drawn from the bundle. That method may include placing a bundle of dunnage products in a container and opening the bundle to line the container. The present invention may be particularly useful for use with insulating dunnage products. The current method for assembly of on-demand sheet-based insulating liners limits the available throughput for end-users due to the labor time and speed of the machine. To improve this throughput and allow for an easily-assembled insulated shipping container, and to provide a method for easy storage of ready-to-use sheet-based insulating liners, the present invention provides an improved method for bundling insulating dunnage products that can be used as insulating liners.

While currently-available insulating materials tend to be bulky, expensive, and are not fully recyclable, the present invention also provides a cost-effective, curbside-recyclable insulating lining for local deliveries. The lining can be provided as part of a kit that can be inserted into a container, but which is compact for storage until ready for use. The insulating lining also can be integrated into the walls of a container as a finished product to remove the kit assembly steps at the packing location.

More particularly, the present invention provides a bundle of packing material that includes at least two strips of packing material folded into a compact bundle. The strips of packing material include a top strip of packing material having a length dimension with first and second end portions and a central portion between the first end portion and the second end portion, and a bottom strip of packing material having a length dimension with first and second end portions and a central portion between the first end portion and the second end portion. The central portion of the top strip overlays the central portion of the bottom strip and the length dimension of the top strip is oriented orthogonal to the length dimension of the bottom strip. The first and second end portions of top strip are folded over the central portion of the top strip, and the first and second end portions of the bottom strip are folded over the central portion of the bottom strip.

The bundle may further include one or more of the following features: (a) the central portion of the top strip has a top side and a bottom side opposite the top side, and the first and second end portions of the top strip are folded over the top side of the top strip, and the first and second end portions of the bottom strip are folded over a top side of the central portion of the top strip; (b) one of the first end portion and the second end portion of the top strip are folded over one of the first end portion and the second end portion of the bottom strip; (c) the first end portions and the second end portions of the top strip and the bottom strip are interleaved; and (d) the strips of packing material are made at least partially of paper, and may include randomly-crumpled paper.

The bundle may further include a restraining member to temporarily secure the strips of packing material in the bundled configuration. The restraining member may be a strap.

The strips of packing material may be selected based on one or more of the following factors: (a) a width dimension of the strip of packing material relative to a width of a respective side wall of a container; (b) insulating properties of the strip of packing material; and (c) cushioning properties of the packing material.

The present invention also provides a method of making a bundle of packing material from two strips of packing material. The method includes the following steps: (a) providing two strips of packing material, including a top strip of packing material having a length dimension with first and second end portions and a central portion between the first end portion and the second end portion, and a bottom strip of packing material having a length dimension with first and second end portions and a central portion between the first end portion and the second end portion; (b) placing the central portion of the top strip over the central portion of the bottom strip such that the length dimension of the top strip is orthogonal to the length dimension of the bottom strip; (c) folding the first end portion and the second end portion of top strip over the central portion of the top strip; and (d) folding the first end portion and the second end portion of the bottom strip over the central portion of the bottom strip.

The method may further include, after the folding steps, the step of (e) applying a restraining member to temporarily secure the strips of packing material in a bundled configuration.

The folding steps may include interleaving the first end portions and the second end portions of the top strip and the bottom strip.

The providing step may include selecting strips of packing material made at least partially of paper.

The providing step may include selecting strips of packing material that include randomly-crumpled paper.

The providing step may include selecting strips of packing material based on one or more of the following factors: (a) a width dimension of the strip of packing material relative to a width of a respective side wall of a container; (b) insulating properties of the strip of packing material; and (c) cushioning properties of the packing material.

The present invention also provides a method of using a bundle of packing material as described above. The method includes the steps of (a) providing a rectangular packing container with an open top side and a closed bottom side opposite the top side; (b) placing the bundle of packing material in the packing container with a bottom side of the central section of the bottom strip against an inner surface of the bottom side of the packing container; and (c) unfolding the first end portions and the second end portions of the top strip and the bottom strip against respective side walls of the packing container.

The method may further include the step of releasing the bundle from a temporary restraining member.

The method may include the step of placing an article to be packed on a top side of the central section of the top strip, and folding respective first end portions and second end portions of the top strip and the bottom strip over the article, and closing the open top side of the packing container.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

The present invention provides a method for making a bundled dunnage product, a method for making the bundled dunnage product, and a method for using the bundled dunnage product to prepare a shipping container to receive one or more articles to be shipped in the container. The bundled dunnage product, which also may be referred to as a bundle, facilitates placement of multiple dunnage products in a container simultaneously, such as for providing cushioning or thermal insulation properties for the shipping container. The bundled dunnage products are readily unbundled to line the container, whereupon the container is ready to receive the articles to be shipped. The bundle also may be referred to as a liner or lining for a shipping container. Unbundling the bundled dunnage products arranges the dunnage products along the inside surfaces of the container to provide the desired cushioning, thermal, or other dunnage properties.

An exemplary strip of dunnage suitable for use in the present invention may be produced by a dunnage conversion machine that converts a sheet stock material into a dunnage product that is relatively thicker and less dense than the stock material. An exemplary machine for converting sheet stock material into a strip of dunnage suitable for use in the present invention is disclosed in International Patent Application Publication No. WO 2009/042664, which is hereby incorporated by reference. That exemplary dunnage conversion machine produces a wrappable dunnage product, but the present invention is not limited to that dunnage product or the illustrated dunnage conversion machine.

Figure 1:
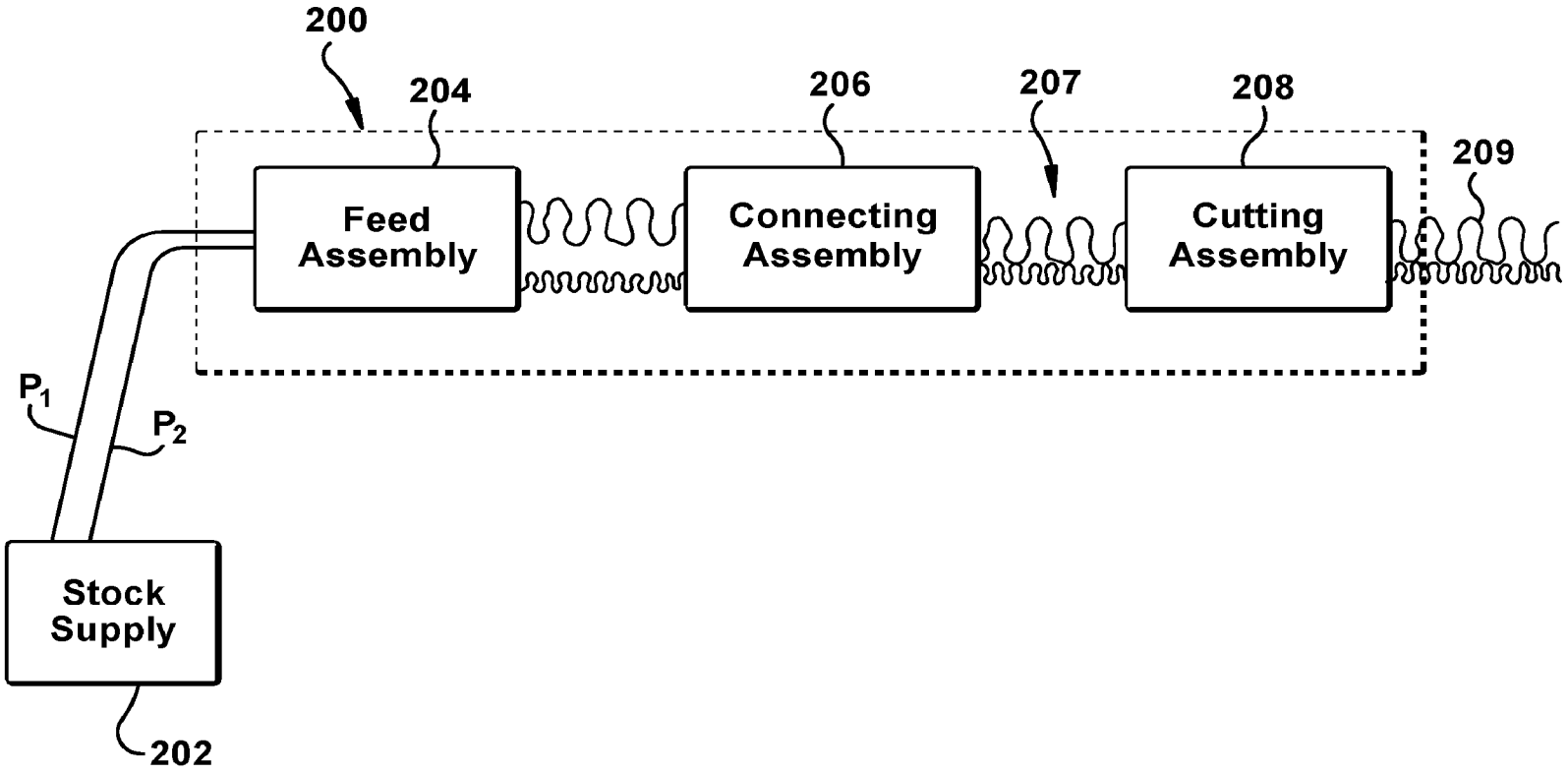
FIG. 1 is a schematic representation of an exemplary dunnage conversion machine.

Referring to FIG. 1, the dunnage conversion machine includes a conversion assembly 200, which further includes both a feed assembly 204 that draws one or more plies $P_1$ and $P_2$ of sheet stock material from a supply 202 of sheet stock material, and a connecting assembly 206 downstream from the feed assembly 204 that connects multiple overlapping layers of sheet material together to form a strip of dunnage 207.

A suitable sheet stock material includes paper or plastic sheets or a combination thereof, supplied as a roll or a fan-folded stack, for example. An exemplary sheet stock material for use in the conversion machine includes either a single-ply or a multi-ply kraft paper provided either in roll form or as a series of connected rectangular pages in a fan-folded stack. Paper is an environmentally-responsible choice for a sheet stock material because it generally is recyclable, reusable, and composed of a renewable resource. The supply of sheet stock material may include multiple rolls or stacks to provide the plies or webs of sheet stock material for conversion into the dunnage product, and subsequent rolls or stacks may be spliced to trailing ends of preceding rolls or stacks to provide a continuous length of sheet stock material to the dunnage conversion machine.

The connecting assembly 206 passes the plies $P_1$ and $P_2$ or sheets of stock material therethrough at a slower rate than the rate at which the plies $P_1$ and $P_2$ are fed from the feed assembly 204 to and through the connecting assembly 206, the connecting assembly 206 thereby cooperating with the feed assembly 204 to cause the stock material to randomly longitudinally crumple or fold in a confined space extending longitudinally between the feed assembly 204 and the connecting assembly 206. The connecting assembly 206 connects the crumpled sheet to another sheet to hold the crumpled sheet in its crumpled state in a continuous strip of dunnage 207. The conversion machine also may include a cutting assembly 208 downstream of the connecting assembly 206 to sever discrete lengths of dunnage product 209 from the strip 207.

At least one ply of the dunnage product 209 thus includes a randomly crumpled web or sheet. Randomly crumpling at least one sheet provides cushioning properties to the dunnage product 209. The crumpled sheet or sheets are held in the crumpled state, for example along the connecting bands, which may be formed from lines of mechanical interconnection with at least one other sheet. The lines of connection where the multiple overlaid sheets or plies are held together also can provide convenient fold lines.

Figure 2:
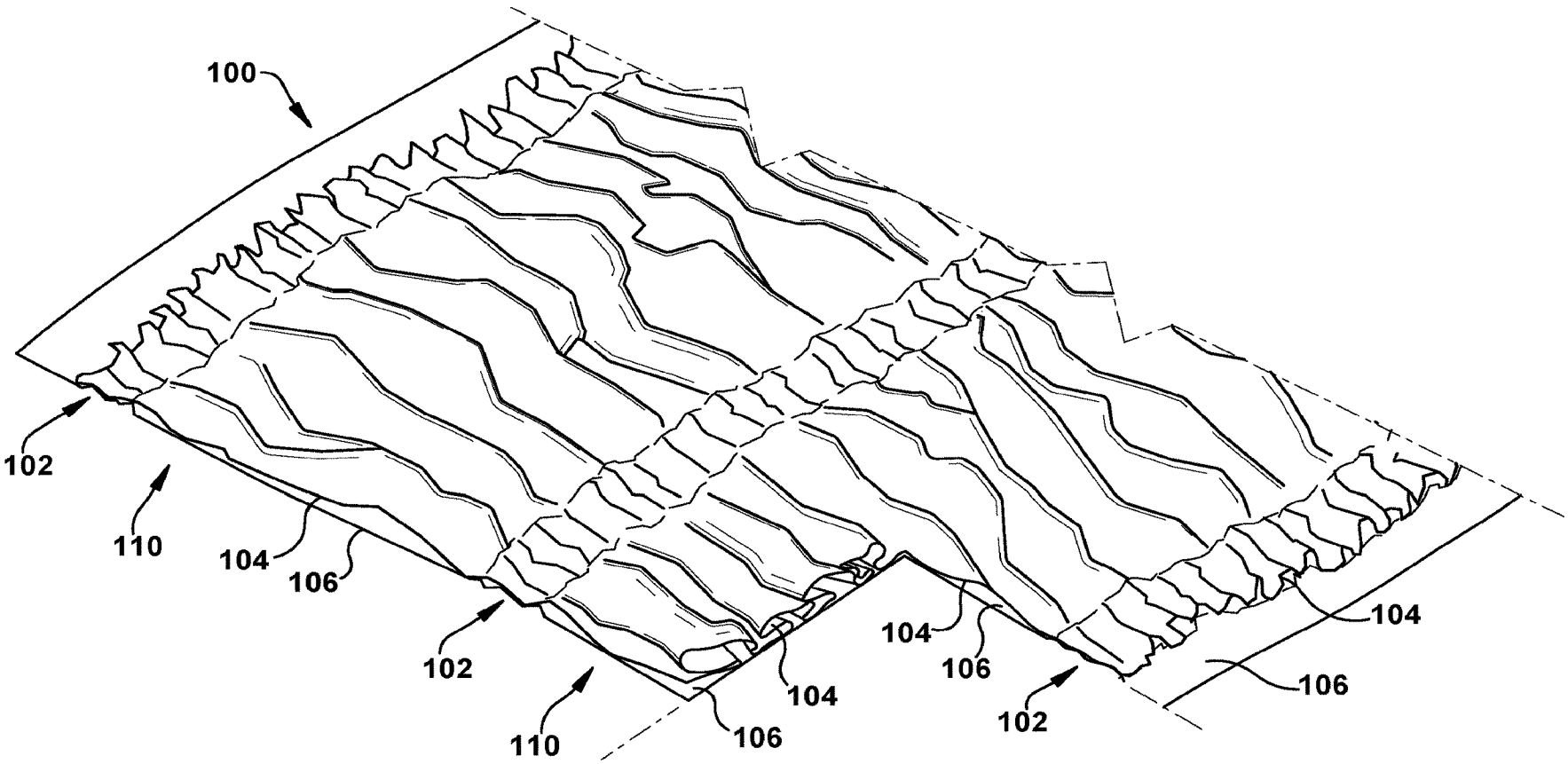
FIG. 2 is a schematic view of a dunnage product produced by the dunnage conversion machine of FIG. 1.

An exemplary dunnage product 100, shown in FIG. 2, includes at least one, and preferably a plurality, of laterally-spaced, longitudinally-extending connecting bands 102 where the sheet stock material is embossed or pierced or punched or otherwise mechanically interconnected to hold multiple plies 104 and 106 of stock material together. The stock material generally is compressed in these connecting bands 102 and thus the crumpled plies 104 provide relatively greater loft in cushioning regions 110 outside the connecting bands 102. In a wrapping product that has an uncrumpled ply 106, the uncrumpled ply acts as a carrier for the crumpled ply. If the same width of stock material is used for the uncrumpled ply 106 and the one or more crumpled plies 104, the crumpling process generally will reduce the width of the crumpled ply or plies 104 such that the uncrumpled carrier ply 106 will extend laterally beyond the laterally-outer edges of the crumpled ply or plies 104. These laterally-outer portions also may be folded inwardly into the connecting bands 102 before or after being connected to further stiffen the dunnage product lengthwise, provide a more consistent finished edge and/or to improve the quality of the connection between the multiple layers of stock material. Additionally, if more than one uncrumpled ply 106 is desired, the additional uncrumpled sheet or sheets may be fed into the connecting assembly 206 (FIG. 1) on the same side or on opposing sides of the crumpled sheet or sheets.

The random crumpling of the crumpled ply or plies 104 and the laterally-spaced connecting bands 102 holding the uncrumpled ply or plies 106 to the crumpled ply or plies 104 provides a high quality dunnage product. Although the exact variation in the crumpled undulations is unpredictable, the amplitude and frequency of the undulations generally can be approximately predicted statistically, and is the result of the differential speed of the feed assembly 204 and the connecting assembly 206, and the size of the space through which a ply $P_1$ or $P_2$ travels.

Changing the number of crumpled sheets, the weight of the stock material employed, or the use of either a crumpled or an uncrumpled carrier sheet can be used to vary the cushioning or other properties of the wrapping product. Cushioning properties also can be controlled by changing a ratio of the feed rate of the stock material through the feed assembly 204 and the connecting assembly 206.

While the dunnage products 100 produced by such a conversion machine described above are particularly suitable for use as a wrapping dunnage product, as described above, the dunnage products 100 also or alternatively may provide desirable cushioning and thermal insulation properties. The use of a dunnage conversion machine allows dunnage products to be produced on-demand, if necessary or desirable. Strips or lengths of such dunnage products, or other dunnage products, may be employed in accordance with the present invention in the following manner.

Strips of packing material, also referred to as strip dunnage products, or sometimes referred to as pads, may have varying lengths, and may have insulating, cushioning, or some combination of such properties. The pads typically have a length dimension greater than a width dimension, and both the width dimension and the length dimension typically are greater than a thickness dimension. The center of the pad is halfway between respective first and second ends or end portions of the pad at opposite ends of the length dimension. A central portion of the pad lies between the lengthwise opposite ends and includes the center. The length of the pad may vary, but typically is long enough to extend across a corresponding dimension of a shipping container. The pad may have a length that is sufficient to extend across multiple inside surfaces of the container, including the inside surfaces of one or more upright side walls and a bottom wall of the container. If a width dimension of the inside surface of the container is greater than a width dimension of a pad, multiple adjacent pads extending in a common direction may be provided.

Figure 4:
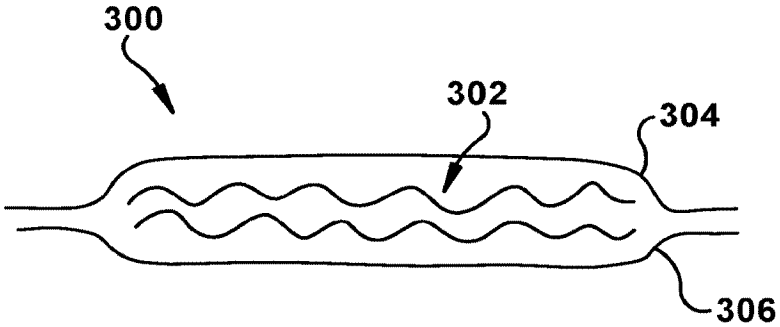
Figure 5:
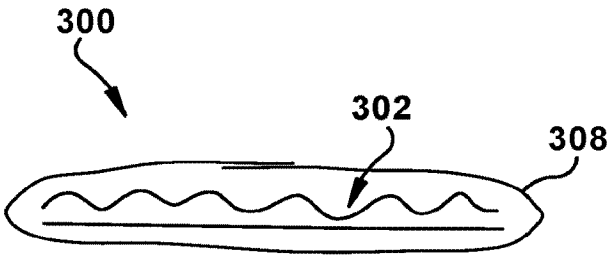
Figure 6:
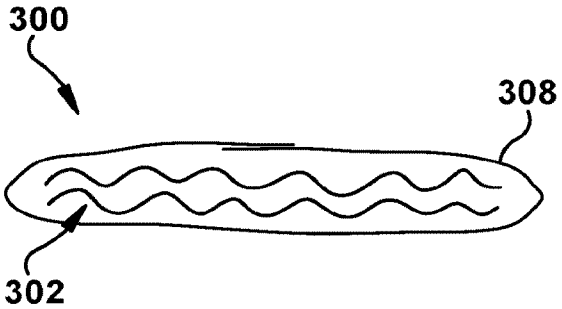

As an alternative to the pads described above and shown in FIGS. 1 and 2, a pad that is intended for use as an insulating lining 300 may include one or more randomly-crumpled sheets 302 of paper sandwiched between two sheets of paper 304 and 306 that are sealed at peripheral edges (FIG. 3 or 4), or a single cover sheet 308 wrapped around interior randomly-crumpled sheets 302 with the edges of the cover sheet 308 extending in common or opposite directions (FIG. 5 or 6). Edges extending in opposite directions may meet or overlap, and a tape or other means for fixing the cover sheet 308 in place may be employed. More layers of interior crumpled sheets 302 may be employed to improve insulating properties and increase the thickness of the insulating lining 300.

Figure 7:
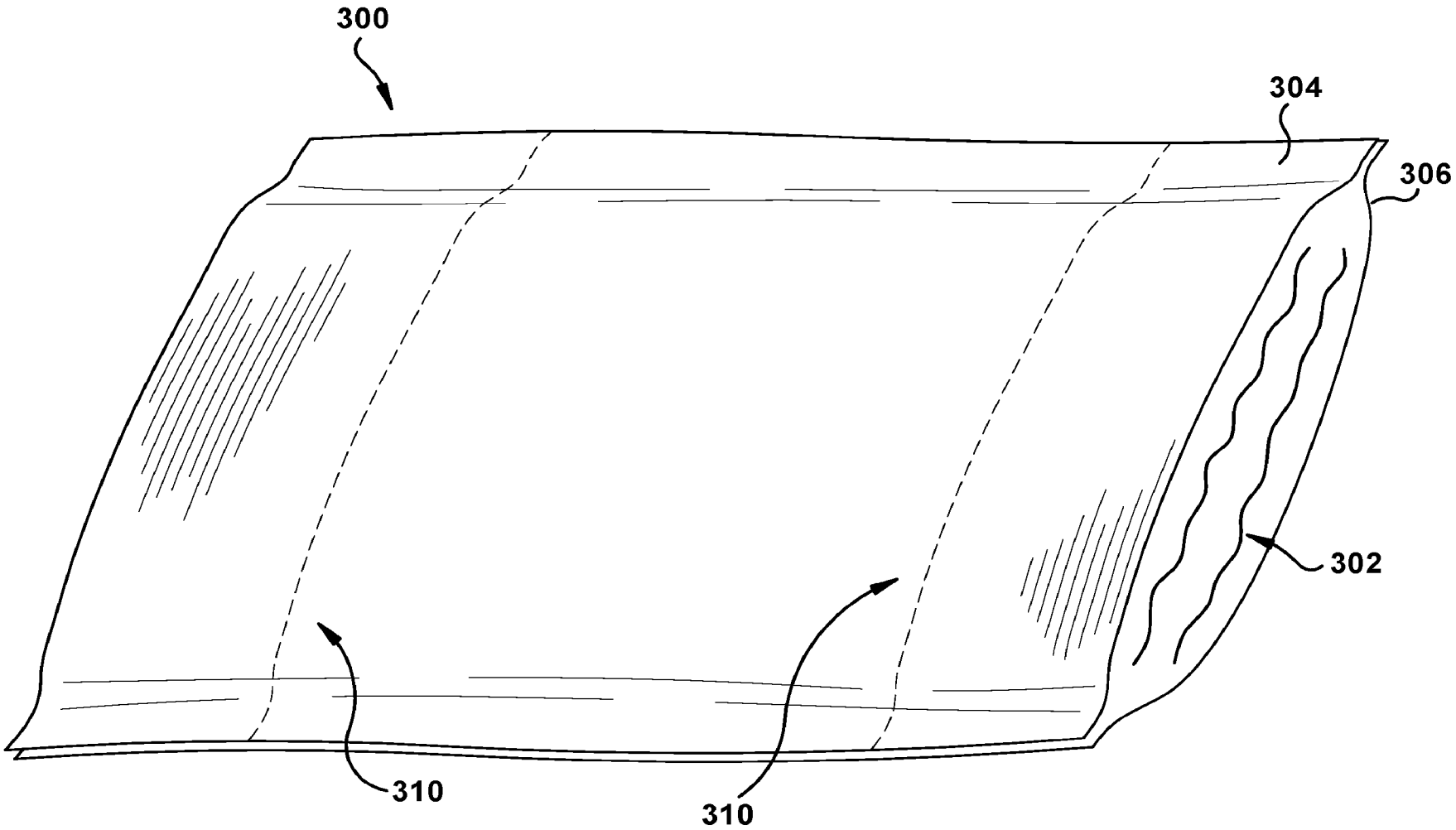
FIG. 7 is a schematic perspective view of an exemplary strip of dunnage provided by the invention.
Figure 8:
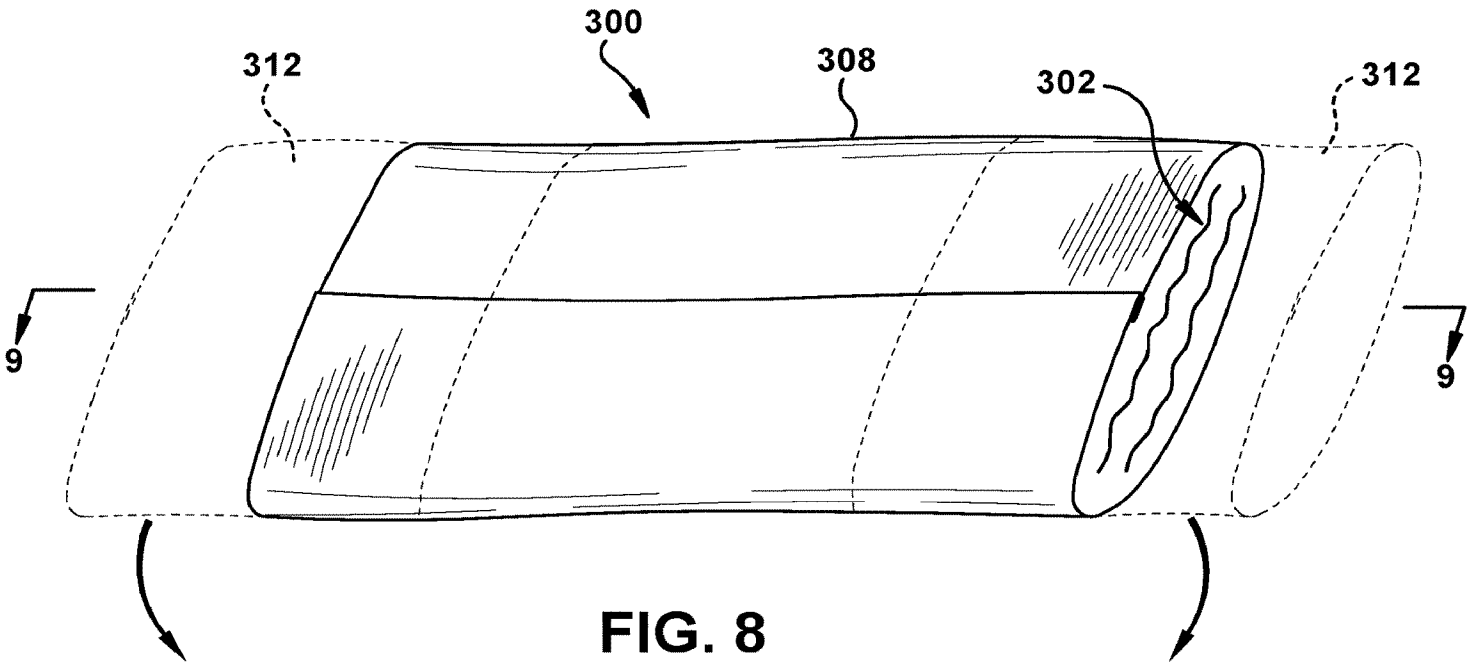
FIG. 8 is a schematic perspective view of another exemplary strip of dunnage provided by the invention.
Figure 9:
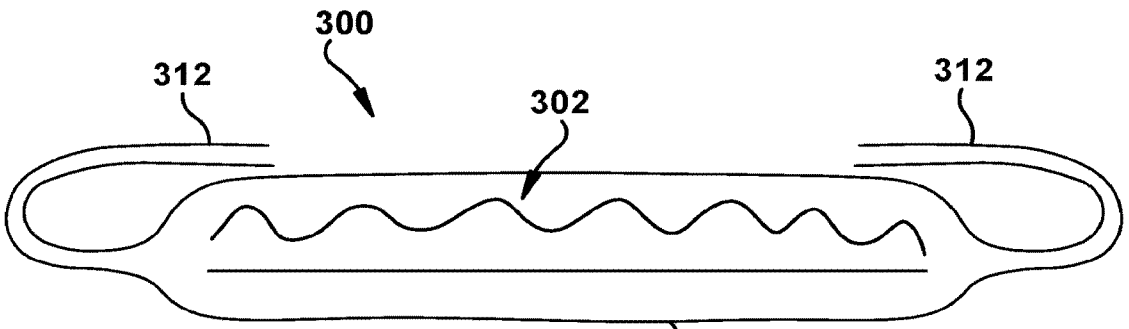
FIG. 9 is a cross-sectional view of the strip of dunnage of FIG. 8 as seen along line 9-9.

Similar to the pads shown in FIGS. 1 and 2, insulating lining 300 also may be produced as a continuous strip, which is then cut to a desired length. As shown in FIG. 7, fold lines 310 or creases may be formed in the insulating lining at predetermined distances along the length to facilitate bending the insulating lining to match the interior dimensions of a shipping container. As shown in FIGS. 8 and 9, ends 312 of the strip may extend beyond the length of the interior crumpled sheets 302 and may be folded over to seal the ends and improve thermal performance. The strip also or alternatively may be sealed at intermediate positions along the length or width of the strip.

The present invention forms or uses a bundled configuration of two or more strips to facilitate inserting multiple strips into a container at one time, ready to be deployed to a desired orientation where the strips are ready to receive and protect articles for shipment. This bundled configuration also may be referred to as a kit.

Figure 10:
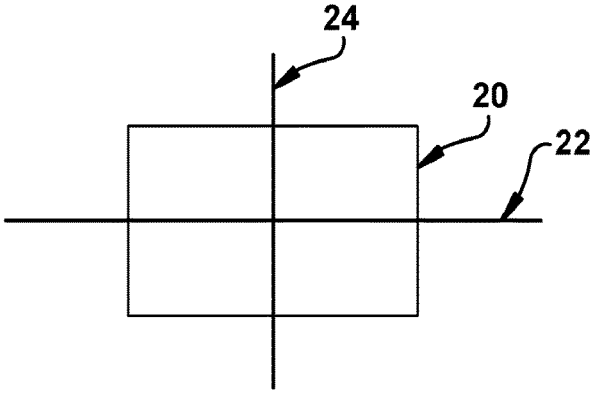
FIG. 10 is a schematic diagram of two strips of dunnage placed over an open shipping container.
Figure 11:
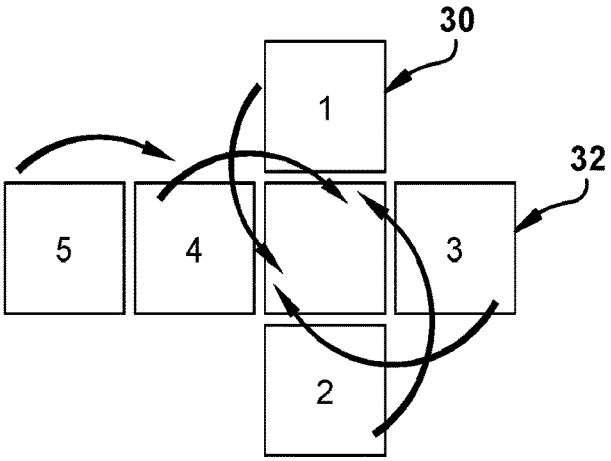
FIG. 11 is a diagram of a sequential folding operation for a pair of pads in a "t" configuration.
Figure 12:
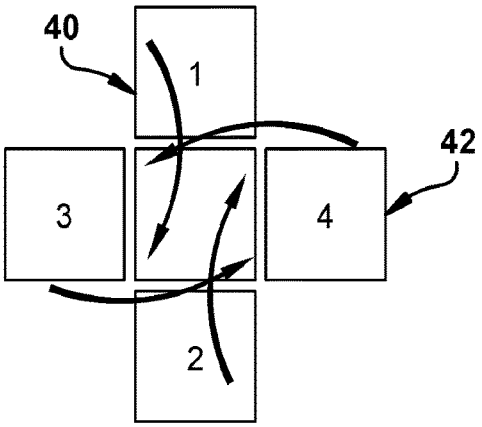
FIG. 12 is a diagram of a sequential folding operation for a pair of pads in a "cross" configuration.
Figure 13:
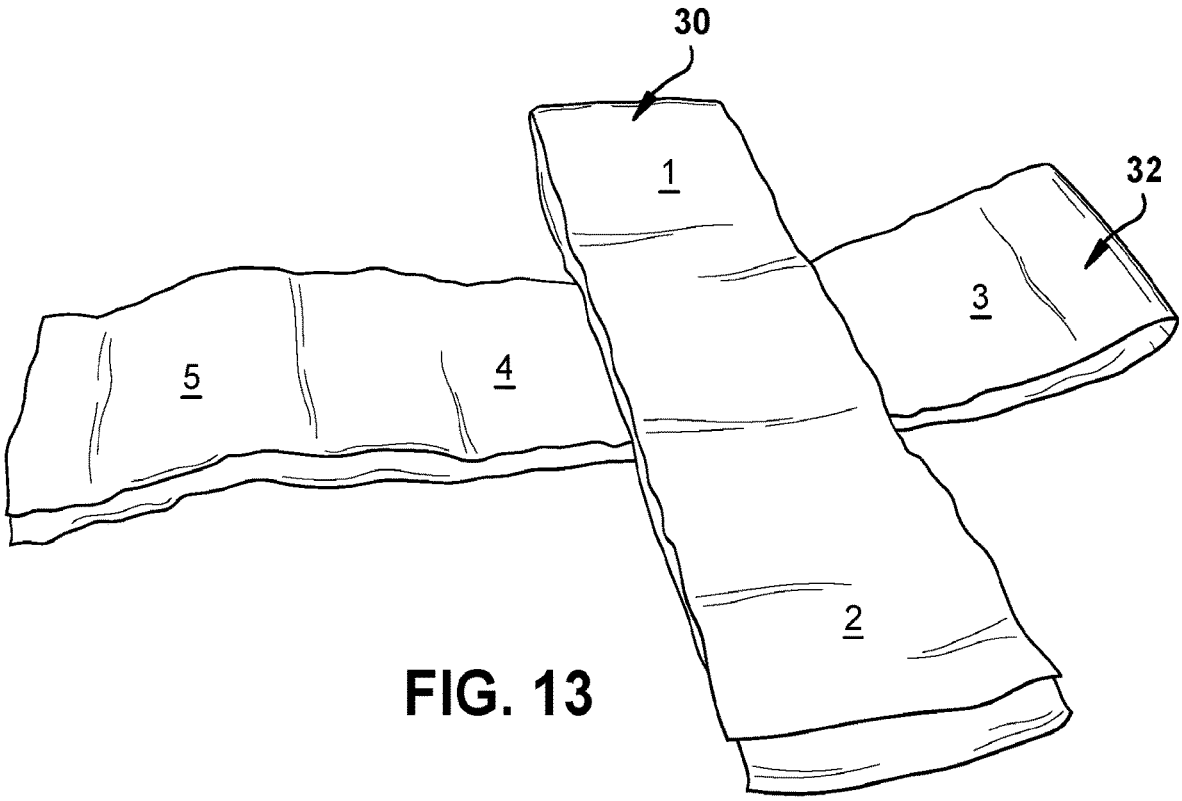
FIGS. 13-19 illustrate sequential steps of a folding operation for a pair of pads in a "cross" configuration to form a bundled dunnage product.
Figure 14:
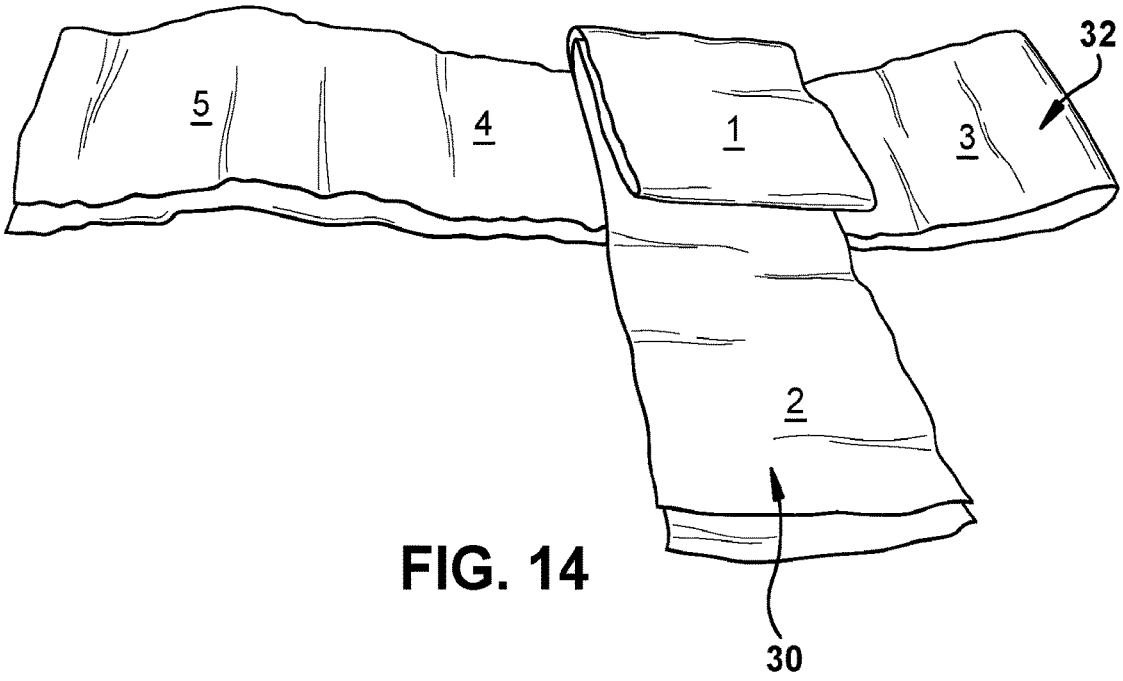
Figure 15:
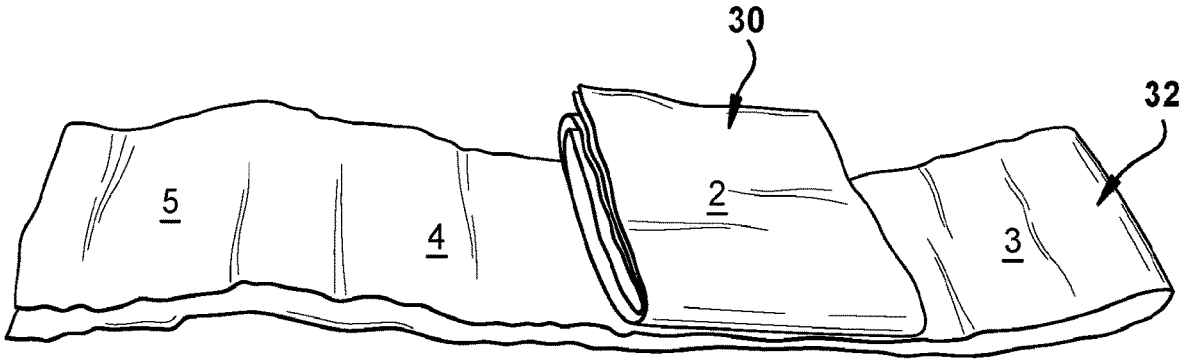
Figure 16:
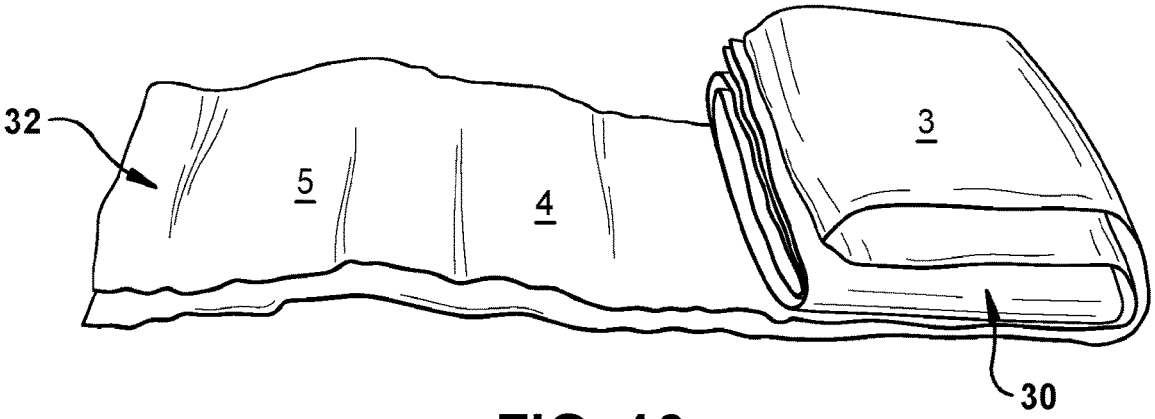
Figure 17:
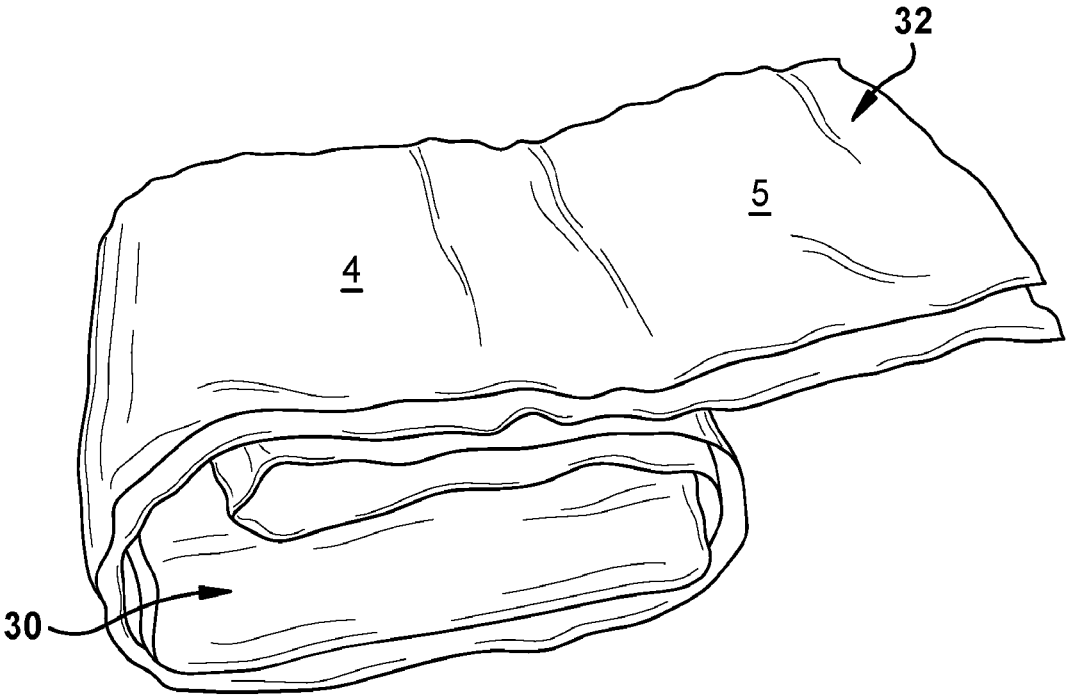
Figure 18:
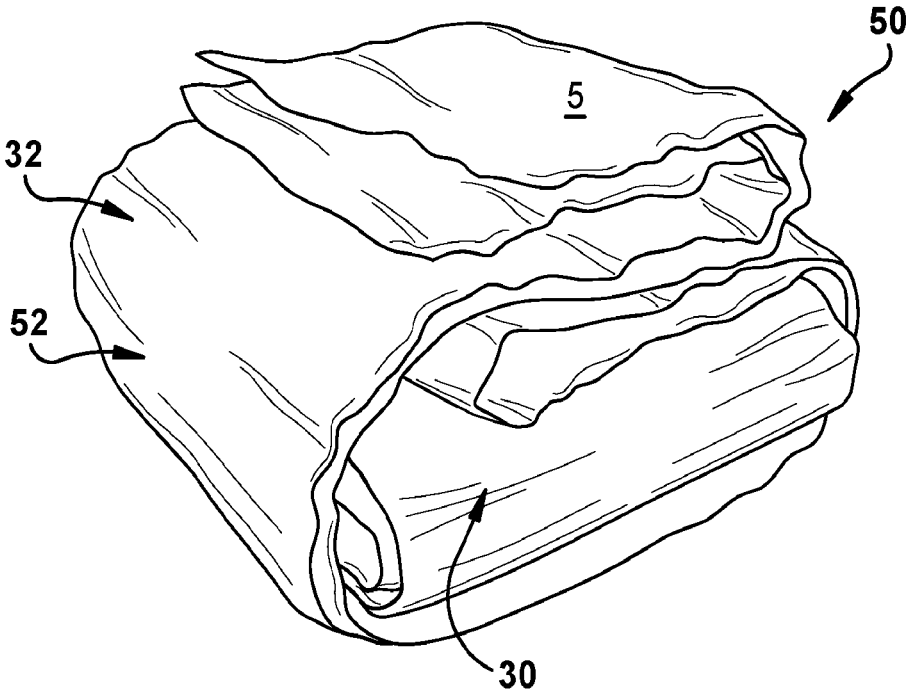
Figure 19:
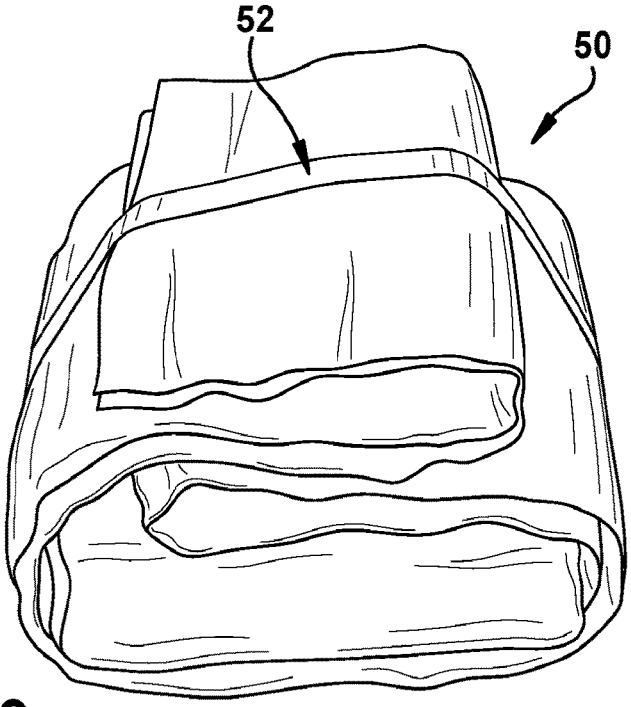
Figure 20:
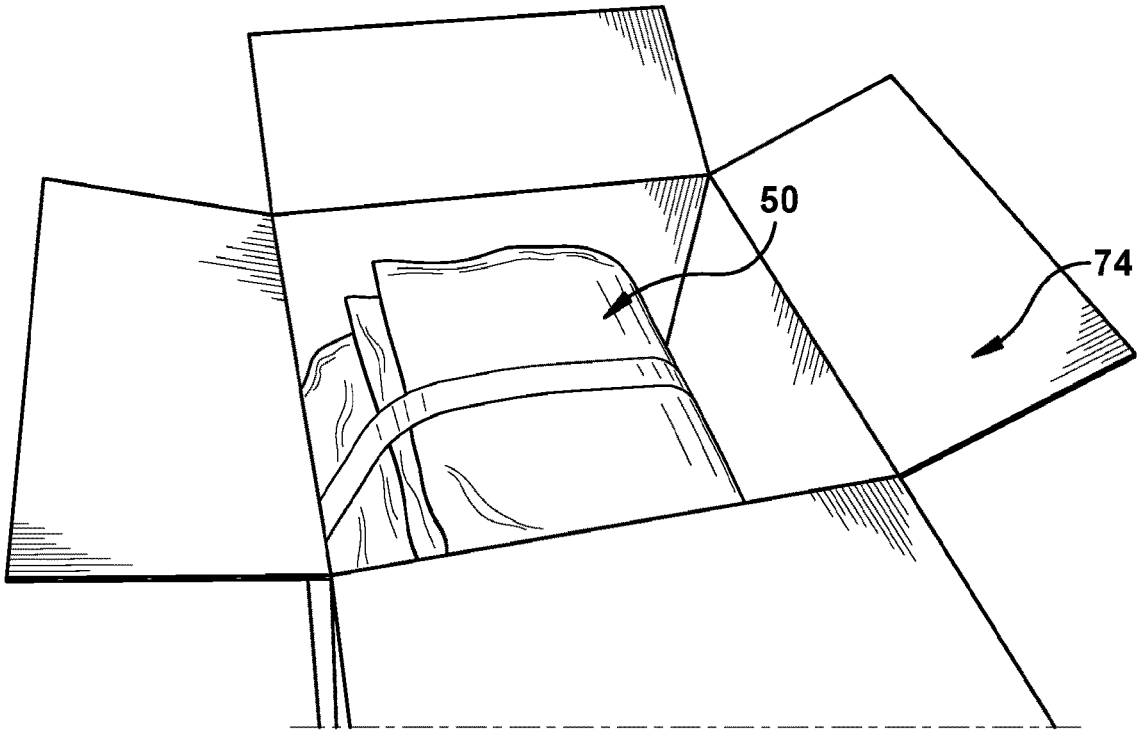
FIGS. 20-23 illustrate sequential steps for using a bundled dunnage product to prepare a shipping container for receipt of one or more articles for packing in the shipping container.
Figure 21:
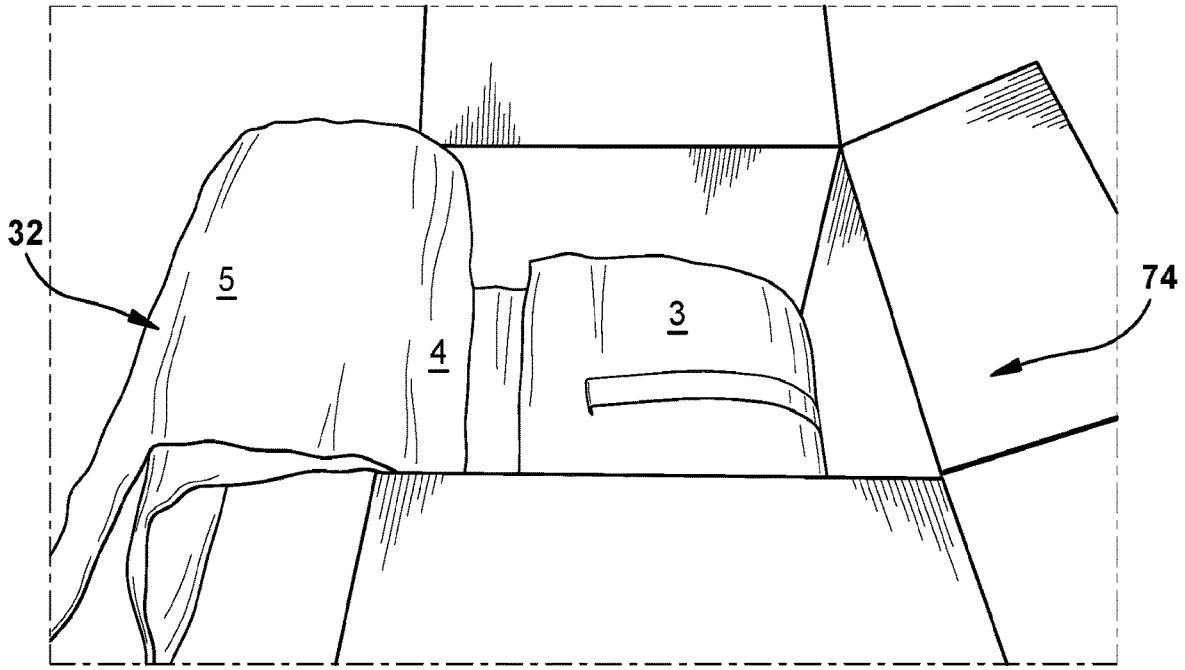
Figure 22:
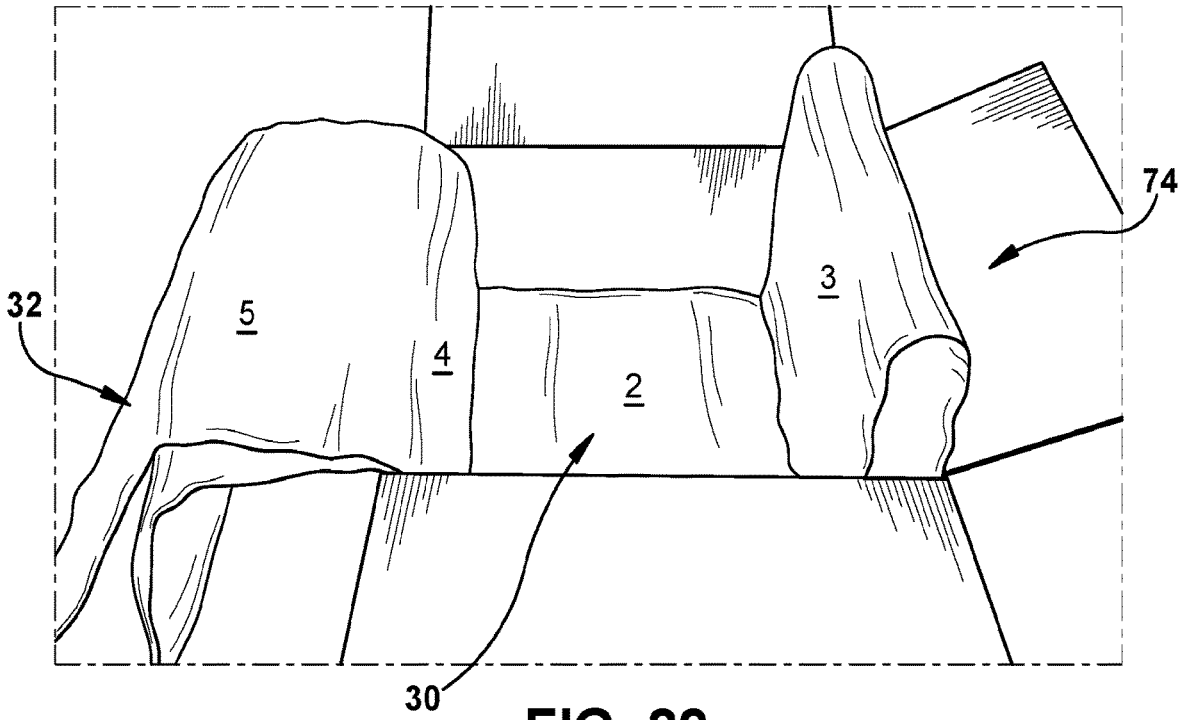
Figure 23:
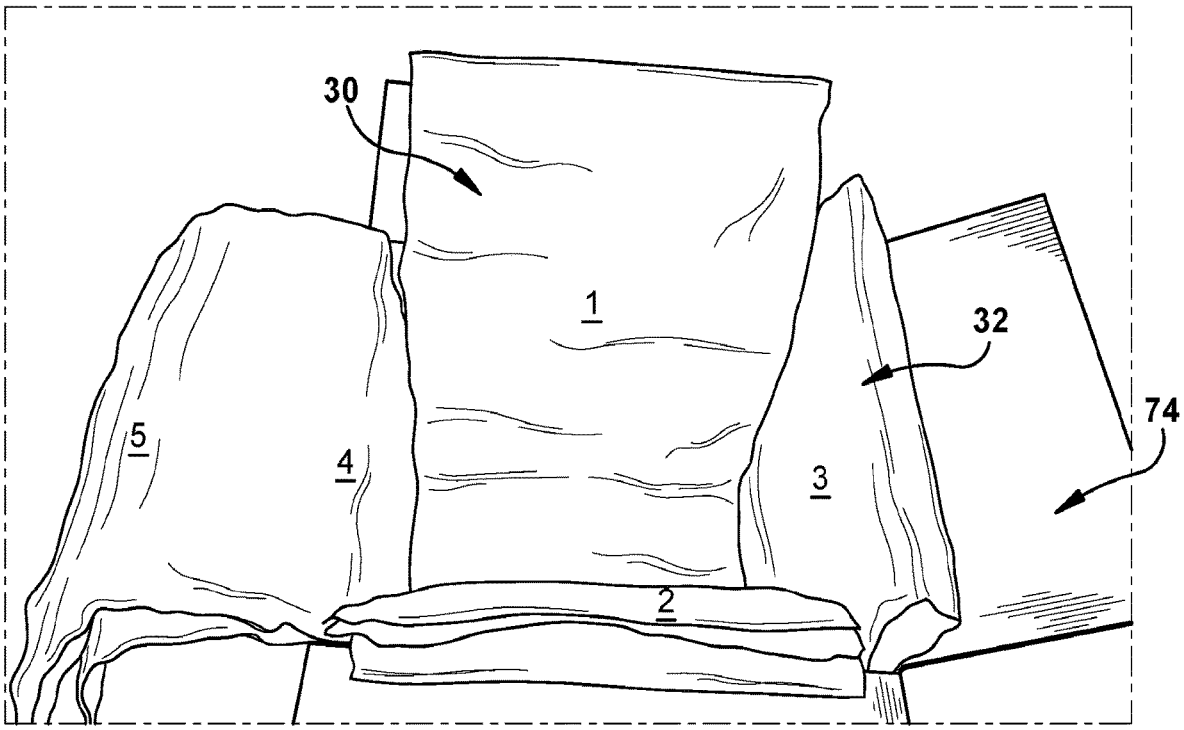

Turning now to a FIG. 10, a typical rectangular shipping container 20 may be provided with a first pad 22 placed in a first position across a bottom surface inside the shipping container 20 and generally perpendicular to parallel opposing side walls of the shipping container 20, and a second pad 24 may be provided across the shipping container perpendicular to the first pad 22, as shown in FIG. 1. The ends of the first and second pad generally extend out of the shipping container, over respective side walls, such that an article to be shipped can be placed on top of the first pad 22 and the second pad 24 and pressed into the shipping container 20, if the first pad 22 and the second pad 24 have not already been pushed downward, into the container 20 or otherwise positioned adjacent the bottom surface of the shipping container 20. Then the ends of the first pad 22 and the second pad 24 will be folded inwardly over central portions of the first pad 22 and the second pad 24, which overlap each other and the bottom surface of the shipping container 20, and over or around the article being shipped. The container then may be closed and otherwise prepared for shipment.

Before the present invention, an operator generally would manually place each pad 22 and 24 across the shipping container, one at a time, potentially having to wait in between for a dunnage conversion machine to dispense the second pad 24. The operator also had to push central portions of the pads to the bottom of the shipping container before placing the article or articles to be shipped in the container and wrapping the ends of the first and second pads 22 and 24 over the article. The present invention provides a method of folding the first pad 22 and the second pad 24 to form a bundle that allows an operator to more quickly and efficiently place multiple pads in the bottom of a shipping container at one time, ready to be unbundled within a container to receive the article to be shipped.

Figure 3:
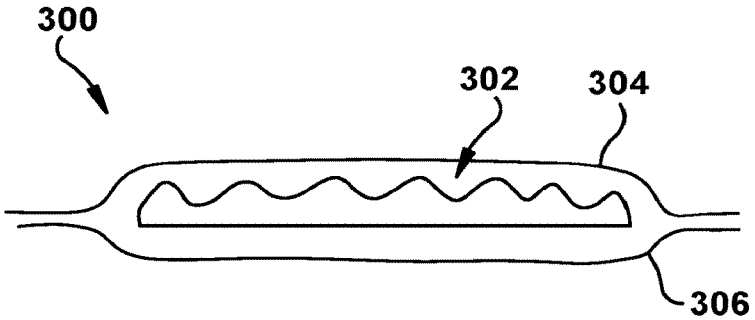
FIGS. 3 to 6 are schematic cross-sections of exemplary strips of dunnage provided by the present invention.

In the first step of bundling the pads, the first pad and the second pad may be arranged to form either a "T" configuration (FIG. 2) or a "cross" configuration (FIG. 3). For ease of description, referring to FIG. 2, formation of a bundle from the T configuration includes the following steps (also shown sequentially in FIGS. 4-8). First, a first pad 30 is placed perpendicular to a second pad 32, with a central portion of the first pad 30 overlapping a central portion of the second pad 32. There is no significance to which pad is on top. The pads may be secured together. The first pad may be the top pad or the bottom pad, and the same can be said of the second pad 32. For comparison, in the cross configuration, a center of a first pad 40 overlays a center of a second pad 42, whereas in the T configuration the center of the first pad 30 does not overlay the center of the second pad 32. In other words, in the T configuration the center of the first pad 30 is off-center relative to the center of the second pad 32, closer to one end of the second pad 32.

Returning to FIG. 3, each pad is separated into sections, and respective sections of the first pad 30 and the second pad 32 then are folded over the unmarked section in the central portion. The order may vary, but in this example the sections are folded over the unmarked section in sequential order of reference numbers (1)-(5). More particularly, a first section (1) of the first pad 30 is folded over the unmarked section of the first pad 30 and the underlying central section of the second pad 32, and then a second section (2) of the first pad 30 is folded over the unmarked section of the second pad 32, and also over the previously-folded first section (1) of the first pad 30. See FIG. 6. Next, the third section (3) of the second pad 32 is folded over the unmarked central section of the second pad 32 (and the central portion and previously inwardly-folded first section (1) and second section (2) of the first pad 30). Finally, the fourth section (4) and the fifth section (5) of the second pad 32 are folded over and around the unmarked section of the second pad 32 (and the previously-folded first through third sections) to form a bundle 50 (see FIGS. 8 and 9). The ends of the pads may be interleaved in the bundle. If any sections are longer than the unmarked section in the central portion, those sections may extend beyond and around the unmarked section.

The resulting folded bundle 50 may be placed in a container for use directly, or may be stored, ready for later use. The bundle 50 also may include a strap 52, or other restraining member or means for holding or securing the first pad 30 and the second pad 32 in the bundled configuration. An exemplary strap 52 is made of paper, with an adhesive securing overlapping ends of the strap 52.

Referring now to FIG. 3, and reference numbers (1)-(4), formation of a bundle from the cross configuration includes similar steps. First, the first pad 40 is placed perpendicular to the second pad 42, with the center of the first pad 40 placed over the center of the second pad 42. Then sections of the first and second pads 40 and 42 are folded over the unmarked central portion in sequential order of reference numbers (1)-(4), with subsequent sections folding over previous sections and around the unmarked central portion, to form a bundle from the two pads. 40 and 42

Each of these methods may vary the order in which the various sections would be folded inward. The size of the bundle preferably is correlated to the size of the packing container and the packaging requirements needed for that container. Factors to consider include the desired properties, whether insulating or cushioning or a combination thereof; the size of the container; the size of the articles being shipped; and the size of the dunnage products in the bundle. Thus, as noted above, more than two pads may be folded into a compact bundle for simultaneous placement in a container, with multiple pads aligned in a common direction, side-by-side, employed to cover container walls that are wider than a single pad. Accordingly, the bundle may include one or multiple first pads, along with one or multiple second pads, as needed for a particular container. Regardless of the number of pads, the resulting bundle makes it very easy for an operator to place multiple pads in a container at once. The bundled arrangement also facilitates aligning the pads against the inside surfaces of the container as the pads are unfolded from the bundle.

The present invention also provides a method for using the bundle to quickly place the dunnage products in a container in a configuration suitable for receiving an article to be shipped. The method includes the following steps, illustrated in FIGS. 11-14, using the bundle 50 from the T configuration described above. First, the bundle 50 (whether secured or unsecured) is placed into a container 74, and any tape, strap, or banding used to hold the pads 30 and 32 in the bundled configuration, if any, is released or removed. Next, the bundling method, whether the T configuration, the cross configuration, or other configuration, would be reversed, opening the first and second pads within the container by unfolding the various sections in reverse order, potentially extending over the sides and outside of the container as sections of the first and second pads are unfolded and placed in a configuration ready to receive one or more articles for shipment, as shown sequentially in FIGS. 11-14.

After the bundle 50 is placed into the container 74 against an inside surface of a bottom wall (FIG. 11), sections 4 and 6 of the second pad 32 are unfolded and placed over an adjacent inside surface of an upright side wall of the shipping container 74 (FIG. 12), and section 3 of the second pad is unfolded against an opposite inside surface of an opposing upright side wall. Then sections 2 and 1 are sequentially unfolded against respective opposing inside surfaces of orthogonal upright side walls of the container 74 in a similar manner. See FIGS. 13 and 14. The container 74 is thus ready to receive articles to be shipped, and simple unfolding placed the first and second pads 30 and 32 in the desired configuration.

Subsequently, the respective sections may be folded over the articles to cover and protect all sides of the articles during shipment. Alternatively or additionally, one or more additional pads may be provided on top of or around the articles before the container is closed, to provide additional protection.

Placing the bundled dunnage products in a container and then unfolding the pads is much easier and quicker than manually arranging multiple pads in a container one at a time, as has been done in the past. Prior methods for assembly of on-demand sheet-based insulating liners, for example, were limited by the speed at which operators could arrange the pads in the container and by the speed at which a dunnage conversion machine could produce pads having the needed length. By providing bundled dunnage products, un-bundling the dunnage products automatically places the dunnage products in a desired configuration for receipt of the articles to be shipped. The bundled dunnage products may be produced on-demand for bundling and use, or pre-produced and stored in a compact bundled configuration until ready to use. The bundling and banding operations may be automated.

In summary, the present invention provides a bundle of packing material that includes at least two strips of packing material folded into a compact configuration. The strips of packing material include a top strip having a length dimension between first and second end portions and a central portion between the first end portion and the second end portion, and a bottom strip having a length dimension between first and second end portions and a central portion between the first end portion and the second end portion. The central portion of the top strip overlays the central portion of the bottom strip and the length dimension of the top strip is oriented orthogonal to the length dimension of the bottom strip. The first and second end portions of top strip are folded over the central portions, and the first and second end portions of the bottom strip are folded over the central portions. A strap may hold the strips in the bundled configuration.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

The invention claimed is:

1. A bundle of packing material, comprising:

at least two strips of packing material folded into a compact bundle, including a top strip of packing material having a length dimension with first and second end portions and a central portion between the first end portion and the second end portion, and a bottom strip of packing material having a length dimension with first and second end portions and a central portion between the first end portion and the second end portion;

where the central portion of the top strip overlays the central portion of the bottom strip and the length dimension of the top strip is oriented orthogonal to the length dimension of the bottom strip, the first and second end portions of top strip are folded over the central portion of the top strip, and the first and second end portions of the bottom strip are folded over the central portion of the bottom strip.

2. The bundle as set forth in claim 1, where the central portion of the top strip has a top side and a bottom side opposite the top side, and the first and second end portions of the top strip are folded over the top side of the top strip, and the first and second end portions of the bottom strip are folded over a top side of the central portion of the top strip.

3. The bundle as set forth in claim 1, where one of the first end portion and the second end portion of the top strip are folded over one of the first end portion and the second end portion of the bottom strip.

4. The bundle as set forth in claim 1, where the first end portions and the second end portions of the top strip and the bottom strip are interleaved.

5. The bundle as set forth in claim 1, further comprising a restraining member to temporarily secure the strips of packing material in the bundled configuration.

6. The bundle as set forth in claim 5, where the restraining member is a strap.

7. The bundle as set forth in claim 1, where the strips of packing material are made at least partially of paper.

8. The bundle as set forth in claim 1, where the strips of packing material include randomly-crumpled paper.

9. The bundle as set forth in claim 1, where the strips of packing material are selected based on one or more of the following factors: (a) a width dimension of the strip of packing material relative to a width of a respective side wall of a container; (b) insulating properties of the strip of packing material; and (c) cushioning properties of the packing material.

10. A method of making a bundle of packing material from two strips of packing material, comprising the steps of:

providing two strips of packing material, including a top strip of packing material having a length dimension with first and second end portions and a central portion between the first end portion and the second end portion, and a bottom strip of packing material having a length dimension with first and second end portions and a central portion between the first end portion and the second end portion;

placing the central portion of the top strip over the central portion of the bottom strip such that the length dimension of the top strip is orthogonal to the length dimension of the bottom strip;

folding the first end portion and the second end portion of top strip over the central portion of the top strip; and folding the first end portion and the second end portion of the bottom strip over the central portion of the bottom strip.

11. The method as set forth in claim 10, after the folding steps, further comprising the step of applying a restraining member to temporarily secure the strips of packing material in a bundled configuration.

12. The method as set forth in claim 10, where the folding steps include interleaving the first end portions and the second end portions of the top strip and the bottom strip.

13. The method as set forth in claim 10, where the providing step includes selecting strips of packing material made at least partially of paper.

14. The method as set forth in claim 10, where the providing step includes selecting strips of packing material that include randomly-crumpled paper.

15. The method as set forth in claim 10, where the providing step includes selecting strips of packing material based on one or more of the following factors: (a) a width dimension of the strip of packing material relative to a width of a respective side wall of a container; (b) insulating properties of the strip of packing material; and (c) cushioning properties of the packing material.

* * * * *